US011808549B2

(12) United States Patent
Danzinger et al.

(10) Patent No.: US 11,808,549 B2
(45) Date of Patent: Nov. 7, 2023

(54) CHEMICAL IRRITANT SPRAY ASSEMBLY THAT ATTACHES TO A HANDGUN

(71) Applicant: Brodan LLC, Surfside, FL (US)

(72) Inventors: Shlomo Danzinger, Surfside, FL (US); Levi Danzinger, Miami, FL (US)

(73) Assignee: BRODAN LLC, Surfside, FL (US)

( * ) Notice: Subject to any disclaimer, the term of this patent is extended or adjusted under 35 U.S.C. 154(b) by 0 days.

(21) Appl. No.: 17/737,944

(22) Filed: May 5, 2022

(65) Prior Publication Data

US 2022/0364834 A1 Nov. 17, 2022

Related U.S. Application Data

(60) Provisional application No. 63/188,438, filed on May 13, 2021.

(51) Int. Cl.
*F41H 9/10* (2006.01)
*F41C 27/00* (2006.01)

(52) U.S. Cl.
CPC ..... *F41H 9/10* (2013.01); *F41C 27/00* (2013.01)

(58) Field of Classification Search
CPC ..... F41H 9/10; F41C 27/06; F41C 27/00
See application file for complete search history.

(56) References Cited

U.S. PATENT DOCUMENTS 1,269,922 A 6/1918 Gadecki
1,333,268 A 3/1920 Masiates
2,124,172 A 7/1938 Wildes et al.
3,109,253 A 11/1963 Eig
3,298,125 A 1/1967 Adrian et al.
3,374,708 A 3/1968 Wall
3,619,930 A 11/1971 Beermann et al.
3,706,151 A 12/1972 McNeill
3,707,793 A 1/1973 Holtor, II
3,733,727 A 5/1973 Jones et al.
3,841,526 A 10/1974 Haskins
3,956,843 A 5/1976 Litman
4,058,921 A 11/1977 Mason
4,316,388 A 2/1982 Mason et al.
4,777,754 A 10/1988 Reynolds, Jr.
(Continued)

FOREIGN PATENT DOCUMENTS

DE 19 15 045 10/1970

*Primary Examiner* — Joshua E Freeman
(74) *Attorney, Agent, or Firm* — LaMorte & Associates, P.C.

(57) ABSTRACT

A device that attaches to a handgun that selectively dispenses material from a pressurized canister. The device defines an internal receptacle of a first length that is sized to receive the pressurized canister. A nozzle is disposed at a first end. The pressurized canister is selectively biased against the spray nozzle by being displaced within the canister receptacle by a manual actuator. An actuator is suspended between the tabs with a pivot joint. This enables the actuator to swing from a first position outside the receptacle to a second position within the receptacle. The part of the actuator that enters the receptacle contacts the pressurized canister and displaces the pressurized canister forward against the spray nozzle. This releases the contents of the pressurized canister through the spray nozzle. The actuator includes two parallel levers that pass to both sides of the handgun's trigger guard.

17 Claims, 7 Drawing Sheets

(56) References Cited

U.S. PATENT DOCUMENTS

| | | | | | |
|---|---|---|---|---|---|
| 5,088,624 | A | | 2/1992 | Hackett et al. | |
| 5,225,623 | A | | 7/1993 | Krasnow | |
| 5,397,029 | A | | 3/1995 | West | |
| 5,473,501 | A | | 12/1995 | Claypool | |
| 5,485,695 | A | | 1/1996 | Glock | |
| 5,531,359 | A | | 7/1996 | Winner | |
| 5,581,898 | A | | 12/1996 | Thummel | |
| 5,671,559 | A | * | 9/1997 | Ludaesher | F41B 9/00 42/1.08 |
| 5,787,628 | A | * | 8/1998 | Teetzel | F41C 27/00 42/1.08 |
| 5,983,548 | A | * | 11/1999 | Ludaescher | F41H 9/10 42/1.08 |
| 6,050,454 | A | * | 4/2000 | Ludaescher | F21V 33/0064 222/162 |
| 6,546,661 | B1 | * | 4/2003 | Staubs | F41H 9/10 42/1.08 |
| 8,510,979 | B1 | * | 8/2013 | Mortimer | F41H 9/10 42/114 |
| 9,170,073 | B2 | * | 10/2015 | Mangold | F41C 27/00 |
| 2014/0048561 | A1 | * | 2/2014 | Mangold | F41H 9/10 222/79 |
| 2022/0364834 | A1 | * | 11/2022 | Danzinger | F41C 27/00 |

* cited by examiner

CHEMICAL IRRITANT SPRAY ASSEMBLY THAT ATTACHES TO A HANDGUN

RELATED APPLICATIONS

The application claims the priority of U.S. Provisional Patent Application No. 63/188,438, filed May 13, 2021.

BACKGROUND OF THE INVENTION

1. Field of the Invention

In general, the present invention relates to accessories that attach to a handgun. More particularly, the present invention relates to attachments that contain and spray chemical irritants when activated.

2. Prior Art Description

Law enforcement officers, and many civilians, have equipment and training to react to both life threatening and non-life threatening situations. For example, many law enforcement officers are issued handguns that should only be used if the life of the officer or the life of another is in immediate danger. These same law enforcement officer may also be issued a Taser® or chemical irritant spray for use if a threat is not life threatening. The problem is that a person can change between being a threat and a non-threat, and vice versa, in an instant. There are many scenarios when a subject presents a threat with a melee weapon such as a knife, hammer, screwdriver crowbar, or the like. While the subject may not present themselves as an immediate threat, such as a person with a firearm would, the situation can escalate in an instant. A subject with a knife who is within 21 feet of an armed person can typically reach that person before they have time to draw their weapon.

It is for this reason that law enforcement officers and trained civilians assume that any person with a melee weapon presents a danger. Accordingly, the person with the weapon is approached with the officer's weapon drawn. Once the weapon is drawn, it is difficult for an officer to utilize the non-lethal systems they may be carrying. To address this problem, systems have been made that enable a canister of chemical irritant to be attached directly to the officer's firearm. In this manner, a law enforcement officer can approach a situation ready to use the handgun and quickly change to the chemical spray irritant if the situation provides a brief window of opportunity for a non-lethal response.

However, there are many problems associated with connecting a non-lethal device to a handgun. The three largest problems are those of functional integrity, safety, and situational activation.

A non-lethal device, when attached to a handgun, must preserve functional integrity. The non-lethal device cannot interfere with any action of the handgun. This includes loading, aiming, and firing. Some handguns have mounting rails that are located in front of the trigger and below the barrel. The rails are traditionally used for the mounting of flashlights or laser sites. If a non-lethal device is attached to a handgun, it must be able to attach to the mounting rails and have the ability to be activated from that position.

A non-lethal device, when attached to a handgun, must be safe. That is, the non-lethal device cannot present a danger of accidental discharge to either the non-lethal device or the handgun. In U.S. Pat. No. 9,170,073 to Mangold, a chemical spray device is mounted to a gun rail. The chemical spray device has a twist activation knob. Accordingly, to activate the chemical spray device, the user must use two hands, one hand to hold the gun and the other hand to activate the chemical spray device. This is less than optimal since the law enforcement officer may not always have both hands free to activate the chemical spray device. Furthermore, the officer would have to alter their grip on the handgun and deviate from the proper grip technique required to operate the handgun safely and effectively.

A non-lethal device, when attached to a handgun, must have situational activation. That is, the non-lethal device must be able to be activated in every situation where the handgun itself can be activated. That is, the non-lethal device must be able to be activated by one hand holding the handgun regardless of which hand is holding the handgun. Furthermore, the non-lethal device must be able to be activated with a simple finger motion and preferably a finger motion that is different from that used to fire the handgun.

U.S. Pat. No. 6,546,661 to Staubs, shows a chemical spray device that is activated by pulling a trigger. This is not optimal because the action of pulling a trigger is also the muscle action used to fire the handgun. As such, it is very possible that muscle memory could cause a person to squeeze the trigger of the handgun when intending to squeeze the trigger of the chemical spray device.

In U.S. Pat. No. 5,983,548 to Ludaescher, a chemical spray device is provided that attaches to a handgun. The device has an activation lever that must be pressed forward in use. However, the activation lever extends to only one side of the handgun. Accordingly, the device is not for ambidextrous use. Further still, in order to press the activation lever forward, the user's hand must brace and apply an equal counter pressure. As such, the hand must squeeze the handgun in order to counter the forward pressure. This squeezing action can also result in the trigger of the handgun being accidentally squeezed.

A need therefore exists for an improved chemical spray device that can be attached to a handgun and has easy ambidextrous activation without requiring the user to use a squeezing action in the hand. This need is met by the present invention as described and claimed below.

SUMMARY OF THE INVENTION

The present invention is a device that attaches to a handgun that can selectively dispense material from a pressurized canister. The device has a body that mounts to the mounting rail of a handgun. The body has a first end and an open second end. Between the ends, the body defines an internal receptacle of a first length that is sized to receive and retain the pressurized canister.

A spray nozzle is disposed at the first end of the body. The spray nozzle is positioned adjacent the dispensing valve of the pressurized canister. The spray nozzle opens the dispensing valve when the pressurized canister is biased against the spray nozzle.

The pressurized canister is selectively biased against the spray nozzle by being displaced within the canister receptacle by a manual actuator. Tabs extend from the second end of the body. The actuator is suspended between the tabs with a pivot joint. This enables the actuator to swing about the pivot joint. This moves part of the actuator from a first position outside the receptacle to a second position within the receptacle. The part of the actuator that enters the receptacle contacts the pressurized canister and displaces the pressurized canister forward against the spray nozzle. This releases the contents of the pressurized canister through the spray nozzle.

The actuator includes two parallel levers that pass to both sides of the handgun's trigger guard. In this manner, the person holding the handgun can activate the device and release the contents of the pressurized canister regardless of whether the handgun is being held in the left hand or the right hand.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be embodied in many ways, only two exemplary embodiments are illustrated. The exemplary embodiments are being shown for the purposes of explanation and description. The exemplary embodiments are selected in order to set forth two of the best modes contemplated for the invention. The illustrated embodiments, however, are merely exemplary and should not be considered limitations when interpreting the scope of the appended claims.

Figure 1:
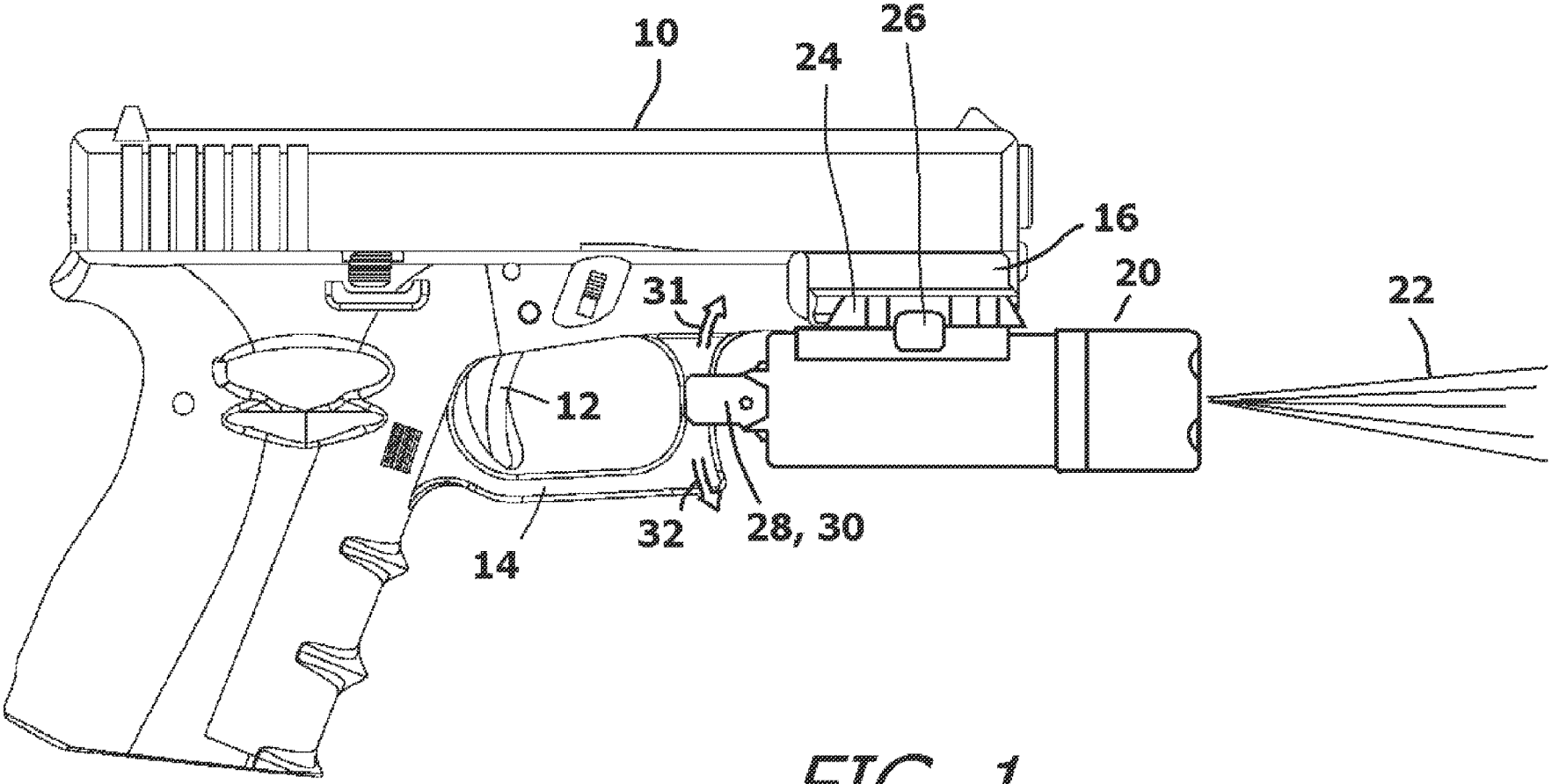
FIG. 1 is a side view of a first exemplary embodiment of the present invention spray dispenser attached to the mounting rail of a handgun.

Referring to FIG. 1, an exemplary handgun 10 is shown. The handgun 10 has a trigger 12, a trigger guard 14, and an accessory mounting rail 16 that is positioned forward of the trigger guard 14. The present invention is a compact spray dispenser 20 that releases a chemical irritant 22 when activated. The chemical irritant 22 is preferably pepper spray or gel, such as Mace®. The spray dispenser 20 is compatible with many handguns and aftermarket holsters available in today's market. This includes both the Safariland® and Blackhawk® light bearing holsters, which are the standard for law enforcement and military.

The spray dispenser 20 attaches to the accessory mounting rail 16 of the handgun 10 utilizing a quick release rail mount 24. The quick release rail mount 24 has an easily accessible release mechanism 26 on both of its sides. By manually manipulating the release mechanisms 26, the quick release rail mount 24 can either engage or disengage the accessory mounting rail 16. In this manner, the entire spray dispenser 20 can be rapidly attached to, or removed from, the handgun 10 without tools.

The spray dispenser 20 has two activation levers 28, 30 that straddle the trigger guard 14. In this manner, one of the activation levers 28, 30 can be easily accessed regardless of whether the handgun 10 is being held in the left hand or the right hand. When held in one hand, the activation levers 28, 30 are positioned at the point where the law enforcement officer is trained to position his/her trigger finger when the handgun 10 is drawn. When held with two hands, the activation levers 28, 30 are designed to be activated by the user's support hand thumb. When the handgun 10 is properly gripped in a two-hand method, the support-hand thumb is positioned directly above one of the activation levers 28, 30. The activation levers 28, 30 are positioned outside the trigger guard 14. As will be explained, the activation levers 28, 30 will activate the spray dispenser 20 only when one of the activation levers 28, 30 is pushed up in the direction of arrow 31 or down in the direction of arrow 32. The activation levers 28, 30 do not activate the spray dispenser 20 when pressed directly toward the handgun 10. In this manner, a law enforcement officer is free to rest his/her finger against one of the activation levers 28, 30 with force, without fear of inadvertently activating the spray dispenser 20.

Figure 2:
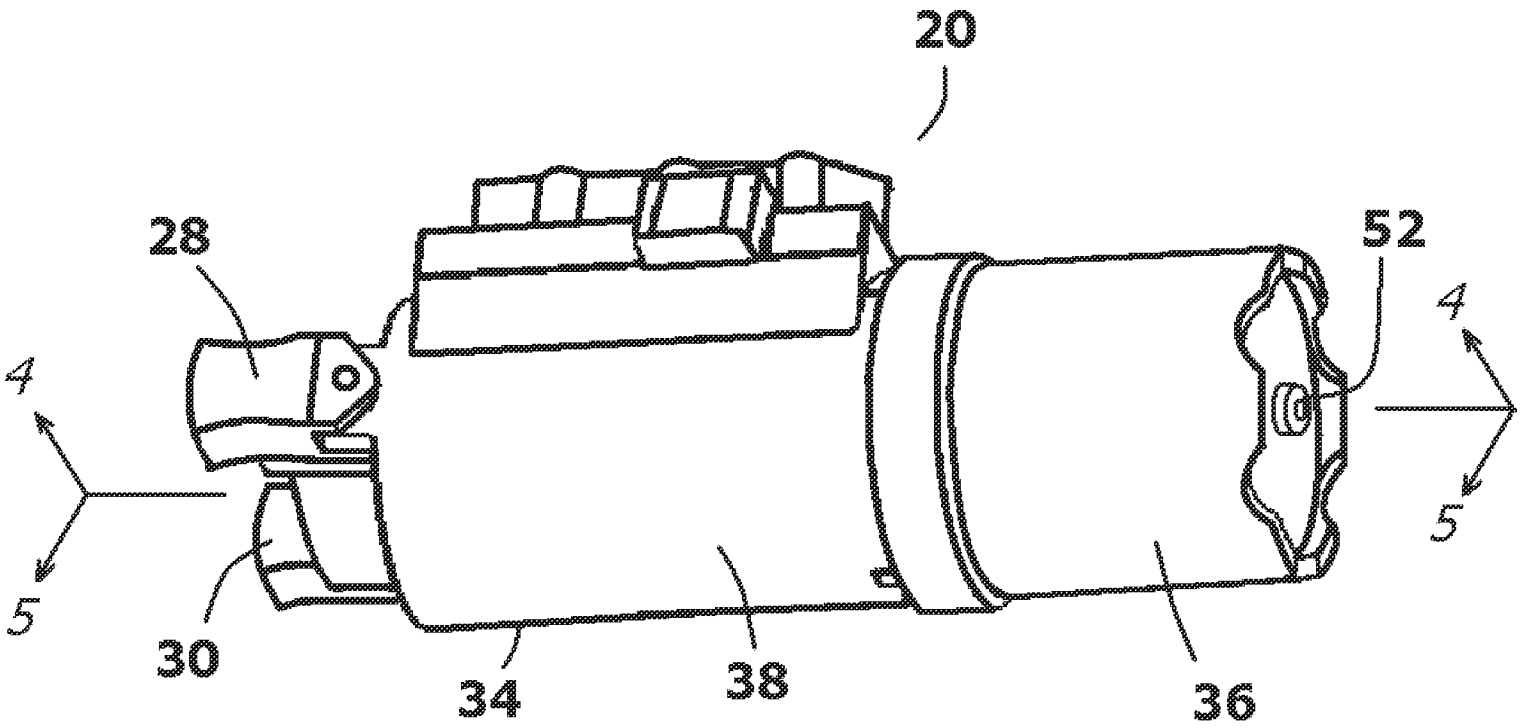
FIG. 2 is an enlarged view of the embodiment of the spray dispenser shown in FIG. 1.
Figure 3:
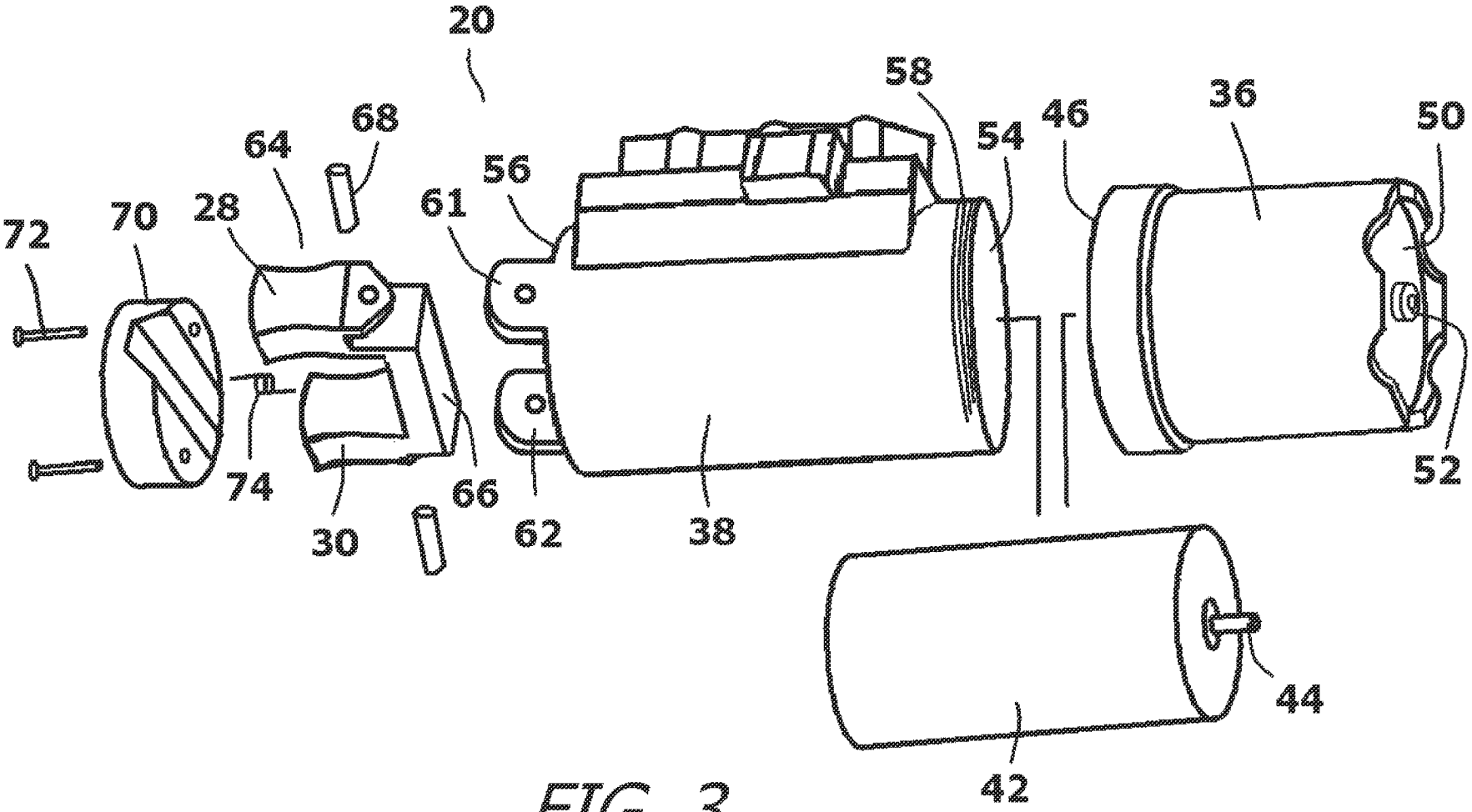
FIG. 3 is an exploded view of the embodiment of the spray dispenser shown in FIG. 2.
Figure 4:
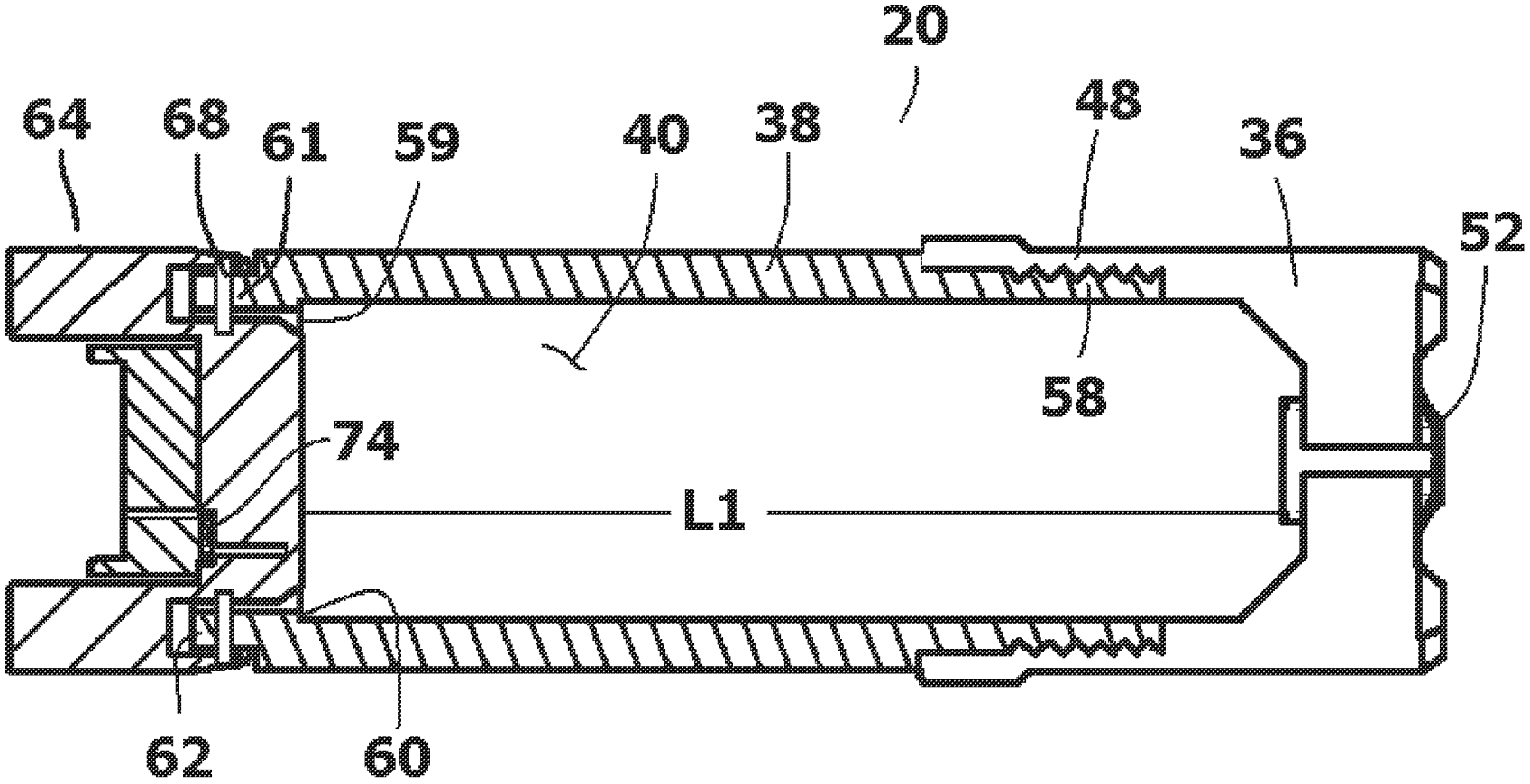
FIG. 4 is a cross-sectional view of the embodiment of the spray dispenser shown in FIG. 2, viewed along section line 4-4.

Referring to FIG. 2, FIG. 3, and FIG. 4 in conjunction with FIG. 1, it can be seen that the spray dispenser 20 has a cylindrical body 34. The cylindrical body 34 has a first part 36 and a second part 38 that interconnect. Once connected, the first part 36 and the second part 38 define a cylindrical body 34. The cylindrical body 34 defines an internal canister receptacle 40. The canister receptacle 40 has a first length L1 and is shaped to receive and retain a pressurized canister 42 of the chemical irritant 22. The pressurized canister 42 has a dispensing valve 44 that releases the chemical irritant 22 from the pressurized canister 42 when depressed.

The first part 36 of the cylindrical body 34 has an open end 46. Threads 48 are formed on the first part 36 proximate the open end 46. The threads 48 are used to selectively connect the first part 36 of the cylindrical body 34 to the second part 38 of the cylindrical body 34. The first part 36 of the cylindrical body 34 has a closed end 50 opposite the open end 46. The closed end 50 also serves as the first end of the overall cylindrical body 34 when the cylindrical body 34 is assembled. A spray nozzle 52 is set into the closed end 50. The spray nozzle 52 is shaped and sized to receive the dispensing valve 44 of the pressurized canister 42. When the dispensing valve 44 of the pressurized canister 42 is pressed against the spray nozzle 52, the chemical irritant 22 leaving the pressurized canister 42 is released and is directed through the spray nozzle 52.

The second part 38 of the cylindrical body 34 has a first open end 54 and a second open end 56. Threads 58 are formed on the second part 38 proximate the first open end 54. The threads 58 on the second part 38 are used to selectively interconnect with the threads 48 on the first part 36 of the cylindrical body 34. The first open end 54 is large enough to receive the pressurized canister 42. The second open end 56 has a reduced opening 59. The second open end 56 also serves as the second end of the overall cylindrical body 34 when the cylindrical body 34 is assembled. The reduced opening 59 at the second open end 56 forms a ridge 60 within the second part 38 of the cylindrical body 34. The pressurized canister 42 rests upon the ridge 60 within the cylindrical body 34.

Two hinge tabs 61, 62 extend from the second open end 56 of the second part 38. The hinge tabs 61, 62 are on opposite sides of the second open end 56. A pivoting actuator 64 is provided. The pivoting actuator 64 is a generally U-shaped structure where the two activation levers 28, 30 extending up from opposite ends of a common contact base 66. The activation levers 28, 30 are connected to the hinge tabs 61, 62 with hinge pins 68. As such, the activation levers 28, 30 are free to rotate about the hinge pins 68. It should be understood that the two small hinge pins 68 shown can be replaced with a single long pivot pin. As the activation levers 28, 30 rotate in one direction above the hinge pins 68, the contact base 66 swings in the opposite direction below the hinge pins 68. When the activation levers 28, 30 are in a straight configuration, relative to the hinge tabs 61, 62 (FIG. 4), the contact base 66 extends a first distance below the hinge pins 68. At this distance, the contact base 66 is positioned adjacent the pressurized canister 42 as it rests on the ridge 60. However, the contact base 66 does not displace the pressurized canister 42 within the canister receptacle 40.

An end cap 70 is provided. The end cap 70 attaches to the second part 38 of the cylindrical body 34 with screws 72. The end cap 70 passes between the activation levers 28, 30 and holds the pivoting actuator 64 in place. However, the end cap 70 does not inhibit the ability of the pivoting actuator 64 to swing about the hinge pins 68.

A spring 74 is provided that engages both the pivoting actuator 64 and the end cap 70. The spring 74 biases the pivoting actuator 64 into the straight configuration of FIG. 4. If the pivoting actuator 64 is manually rotated out of its straight configuration and released, the bias of the spring 74 will automatically return the pivoting actuator 64 to its straight configuration.

Figure 5:
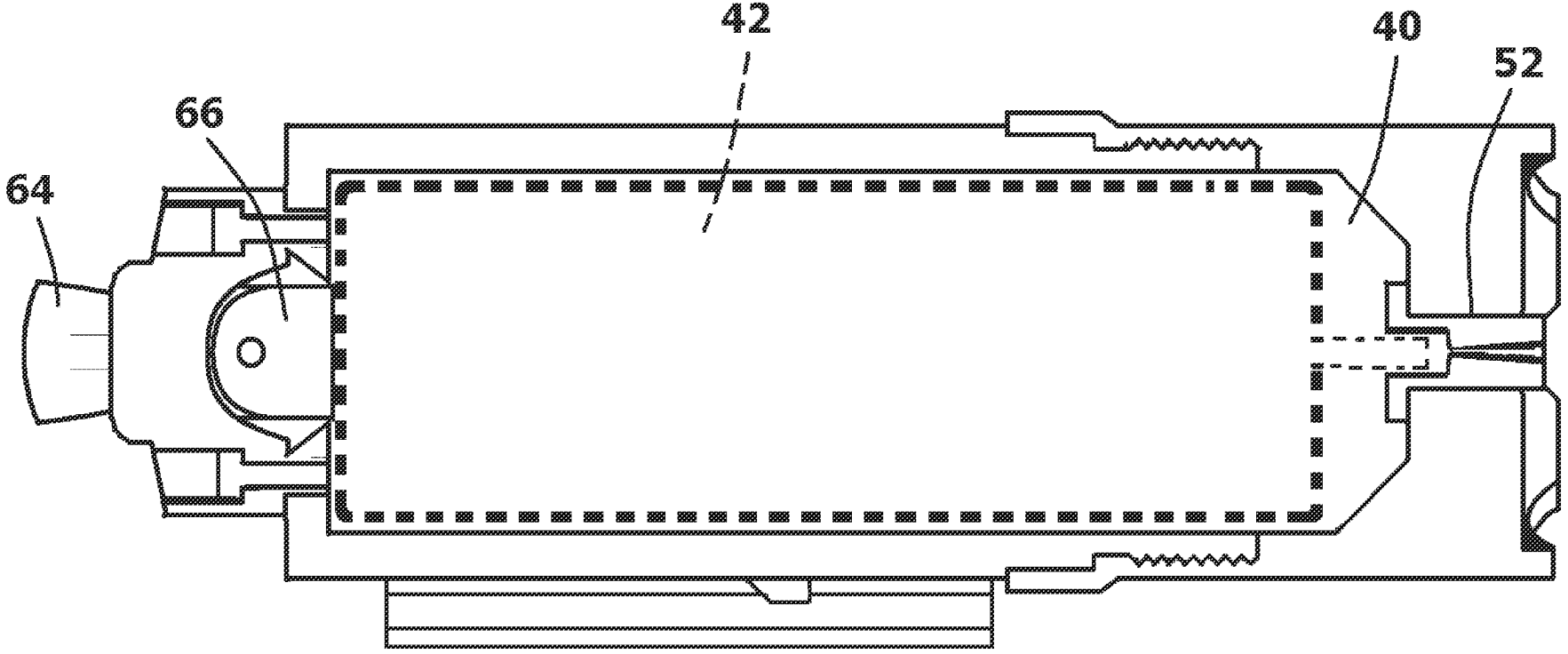
FIG. 5 is a cross-sectional view of the embodiment of the spray dispenser shown in FIG. 2, viewed along section line 5-5.
Figure 6:
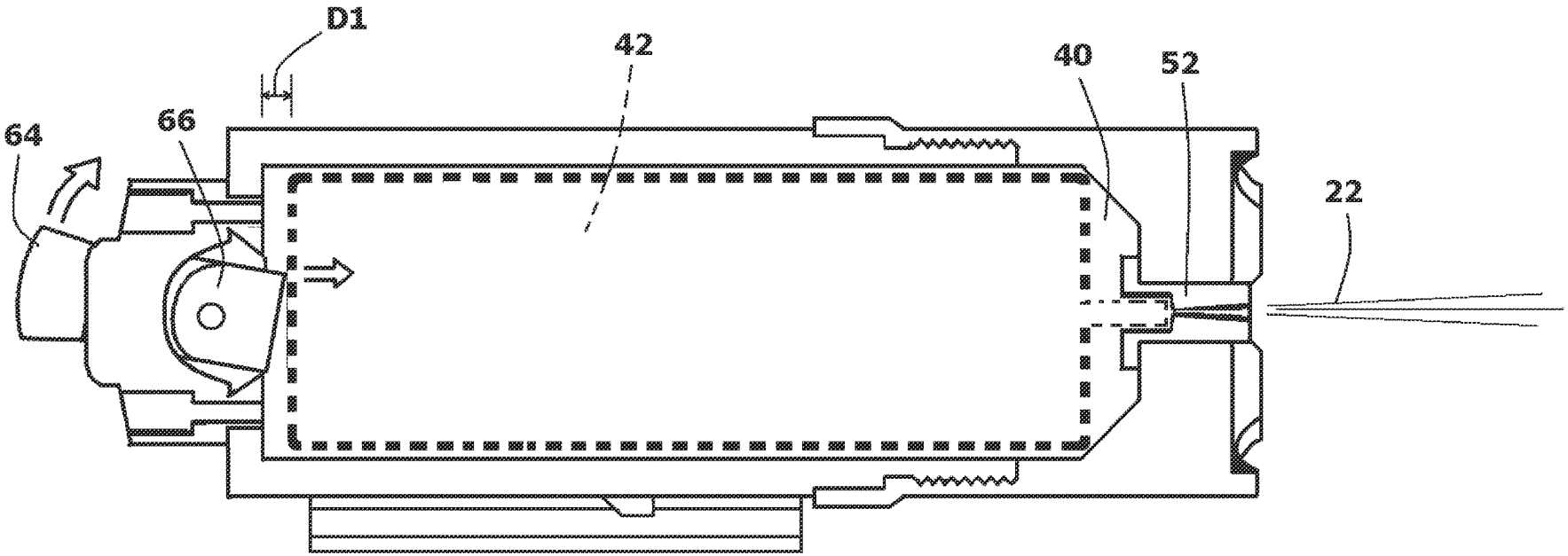
FIG. 6 is a cross-sectional view of the embodiment of the spray dispenser shown in FIG. 2, shown in an activated condition.

Referring to FIG. 5 and FIG. 6, in conjunction with FIG. 3 and FIG. 4, it can be seen that when the pivoting actuator 64 is rotated out of its straight configuration, the contact base 66 rotates a distance D1 into the canister receptacle 40. At this second distance, the contact base 66 contacts the pressurized canister 42 in the canister receptacle 40 and displaces the pressurized canister 42 forward. Upon being displaced forward, the dispensing valve 44 is pressed against the spray nozzle 52. This activates the dispensing valve 44 and releases the chemical irritant 22 through the spray nozzle 52. The chemical irritant 22 is released until the manual rotation of the pivoting actuator 64 is released. Upon release, the spring 74 returns the pivoting actuator 64 to its straight configuration.

It will be understood that the ability of the pivoting actuator 64 to swings within the cylindrical body 34 is limited by the internal diameter of the cylindrical body 34. If additional displacement is required, an additional contact plate can be placed between the pivoting actuator 64 and the pressurized canister 42 to extend displacement.

Figure 7:
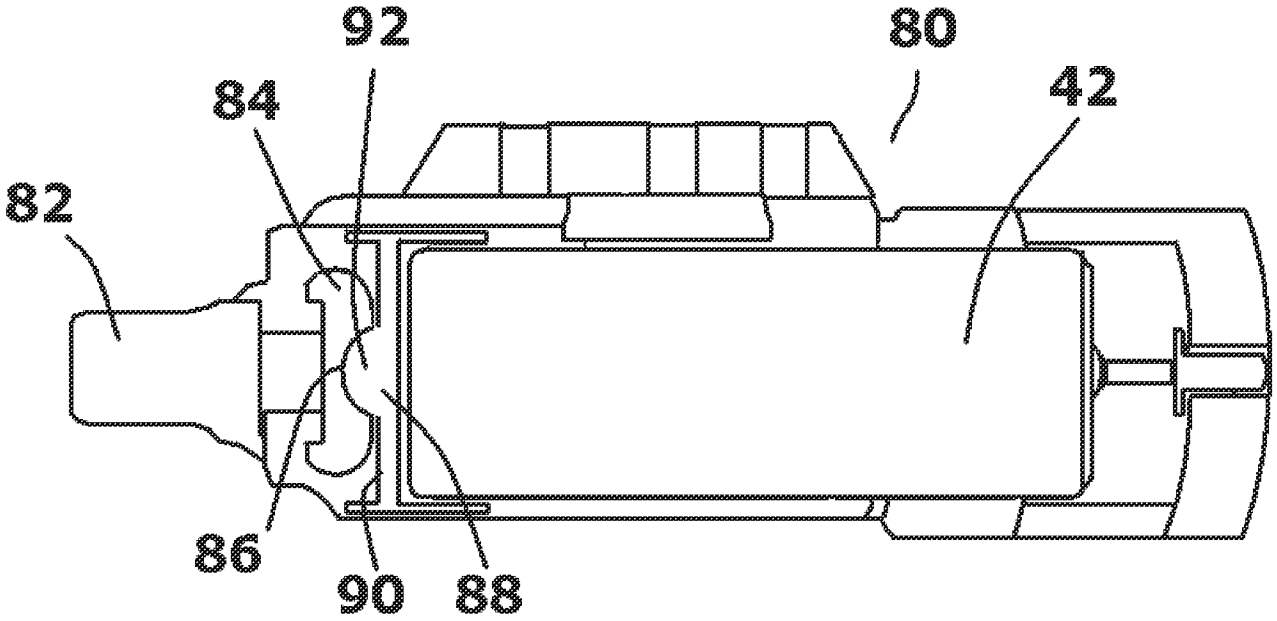
FIG. 7 is a cross-sectional view of a second exemplary embodiment of the present invention spray dispenser.

Referring to FIG. 7, such an alternate embodiment of a spray dispenser 80 is shown. In this embodiment, a pivoting actuator 82 is the same as has been previously described, with the addition of protrusions 84 on a contact base 86. An auxiliary contact plate 88 is provided between the contact base 86 and the pressurized canister 42. The contact plate 88 has a rear wall 90 that faces toward the contact base 86. A first set of half sphere protrusions 92 are formed on the rear wall 90 of the contact plate 88. The first set of half sphere protrusions 92 on the rear wall 90 intermesh with the protrusions 84 on the contact base 86. When the pivoting actuator 82 is rotated, the protrusions 84 on the contact base 86 rotate atop the first set of half-sphere protrusions 92 on the rear wall 90 on the auxiliary contact plate 88. Consequently, the contact forces bias the auxiliary contact plate 88 against the pressurized canister 42. The pressurized canister 42 is then activated in the manner previously described.

It will be understood that the embodiments of the present invention that are illustrated and described are merely exemplary and that a person skilled in the art can make many variations to those embodiments. All such embodiments are intended to be included within the scope of the present invention as defined by the appended claims.

What is claimed is:

1. A device for selectively dispensing material from a pressurized canister, said device comprising:

a body having a first end and an open second end, wherein said body defines an internal receptacle of a first length that is sized to receive said pressurized canister therein, a spray nozzle supported by said body at said first end;

two opposing tabs that extend from said open second end of said body;

an actuator suspended between said opposing tabs with a pivot joint, wherein said actuator can swing about said pivot joint between a first position outside said receptacle and a second position within said receptacle, wherein when in said second position, said actuator extends into said internal receptacle pressing said pressurized canister against said nozzle when said pressurized canister is present within said receptacle.

2. The device according to claim 1, wherein said actuator includes a base that moves between said first position and said second position and two levers that extend in parallel from opposite sides of said base.

3. The device according to claim 2, wherein said levers extend out of said body beyond said tabs.

4. The device according to claim 3, wherein said pivot joint extends through said levers.

5. The device according to claim 3, further including a spring to bias said actuator into said first position.

6. The device according to claim 5, wherein said spring extends from said actuator to said end cap.

7. The device according to claim 2, further including an end cap that is disposed between said two levers, wherein said end cap is affixed to said body in a set position.

8. The device according to claim 7, wherein said pivot joint includes pivot pins that extend through said levers and into said end cap.

9. The device according to claim 1, further including a movable contact plate disposed between said actuator and said internal receptacle, wherein said contact plate is displaced by said actuator when said actuator moves between said first position and said second position.

10. The device according to claim 1, further including a gun rail mount coupled to said body.

11. The device according to claim 1, wherein said body contains a first part and a second part that can be selectively separated and connected to provide access to said internal receptacle.

12. A device for selectively dispensing material, said device comprising:

a pressurized canister of a chemical irritant;

a body having a first end and an open second end, wherein said body defines an internal receptacle that is sized to receive and retain said pressurized canister;

two opposed tabs that extend from said open second end of said body;

an actuator suspended between said opposed tabs with a pivot joint, wherein said actuator can swing about said pivot joint between a first position outside said receptacle and a second position within said receptacle, wherein when in said second position, said actuator displaces said pressurized canister, therein causing said pressurized canister to release said chemical irritant.

13. The device according to claim 12, wherein said actuator includes a base that moves between said first position and said second position and two levers that extend in parallel from opposite sides of said base, wherein said levers extend out of said body beyond said tabs.

14. The device according to claim 13, wherein said pivot joint extends through said levers.

15. The device according to claim 13, further including an end cap that is disposed between said two levers, wherein said end cap is affixed to said body in a set position.

16. The device according to claim 12, further including a spring to bias said actuator into said first position.

17. The device according to claim 12, further including a gun rail mount coupled to said body.

* * * * *